US010974794B2

(12) United States Patent
Reiss, Jr.

(10) Patent No.: US 10,974,794 B2
(45) Date of Patent: Apr. 13, 2021

(54) CASELESS FLOAT FOR WATERWAY BARRIER INCORPORATING SAME

(71) Applicant: Thomas J. Reiss, Jr., Ixonia, WI (US)

(72) Inventor: Thomas J. Reiss, Jr., Ixonia, WI (US)

(73) Assignee: Reiss International, Ltd., Watertown, WI (US)

( * ) Notice: Subject to any disclaimer, the term of this patent is extended or adjusted under 35 U.S.C. 154(b) by 0 days.

(21) Appl. No.: 16/160,665

(22) Filed: Oct. 15, 2018

(65) Prior Publication Data

US 2019/0127027 A1 May 2, 2019

Related U.S. Application Data

(60) Provisional application No. 62/579,632, filed on Oct. 31, 2017.

(51) Int. Cl.
*B63B 22/16* (2006.01)

(52) U.S. Cl.
CPC ..... *B63B 22/16* (2013.01); *B63B 2231/48* (2013.01)

(58) Field of Classification Search
CPC ..... B63B 22/16; B63B 2231/48; B63B 22/00; B63B 22/02
See application file for complete search history.

(56) References Cited

U.S. PATENT DOCUMENTS

| | | | | |
|---|---|---|---|---|
| 5,330,378 | A * | 7/1994 | Park | B63B 21/20 114/267 |
| 6,843,695 | B1 * | 1/2005 | Jackson | A61H 3/008 441/129 |
| 6,960,047 | B2 * | 11/2005 | Knezek | B63B 5/24 |
| 7,337,568 | B2 * | 3/2008 | Johnson | G09F 21/18 114/264 |
| 8,695,947 | B2 * | 4/2014 | Bishop | F41H 11/05 256/13 |
| 2015/0110546 | A1 * | 4/2015 | Knezek | F41H 11/05 403/220 |

OTHER PUBLICATIONS

Jim Buoy http://web.archive.org/web/20150430182951/http://www.jimbuoy.com/pages/marine/floats.htm (web page archived at least as early as Apr. 30, 2015) retrieved on Dec. 23, 2019 (Year: 2015).*
Why Use Polyurethane Foam https://www.generalplastics.com/why-polyurethane (web page archived at least as early as Oct. 17, 2017) retrieved by examiner on Jun. 11, 2020 http://web.archive.org/web/20171019170408/https://www.generalplastics.com/why-polyurethane. (Year: 2017).*
HDU Marine Board https://precisionboard.com/marine-board-precision-board/(web page archived at least as early as Mar. 22, 2016) retrieved by examiner on Dec. 1, 2020 (Year: 2016).*

* cited by examiner

*Primary Examiner* — Anthony D Wiest
(74) *Attorney, Agent, or Firm* — Reinhart Boerner Van Deuren P.C.

(57) ABSTRACT

A float for a barrier for a waterway, a waterway barrier including the float, and a method for forming the waterway barrier are provided. The float includes a caseless float body which is formed of a single, homogeneous material. The material may be a high density urethane or a functional equivalent.

17 Claims, 3 Drawing Sheets

CASELESS FLOAT FOR WATERWAY BARRIER INCORPORATING SAME

CROSS-REFERENCE TO RELATED PATENT APPLICATION

This patent application claims the benefit of U.S. Provisional Patent Application No. 62/579,632, filed Oct. 31, 2017, the entire teachings and disclosure of which are incorporated herein by reference thereto.

FIELD OF THE INVENTION

The invention generally relates to devices used in navigable and non-navigable waterways, and more particularly to barriers for such waterways, and more particularly to floats used for such barriers.

BACKGROUND OF THE INVENTION

Contemporary barriers for waterways come in a variety of forms and perform in a variety of applications. For example, these barriers may be used in wildlife barrier applications to reduce/prevent wildlife such as fish from entering a given area of a waterway, e.g. the entrance of a hydroelectric dam or the like. As another example, such barriers are often times used as debris collection devices for collecting debris and cordoning the same to a specific area in the waterway. As yet another example, these barriers may be used in safety applications and thereby restrict access by boats, swimmers, etc. to a given area of a waterway.

While such barriers may come in many forms, they primarily consist of a number of elongated floats which are connected to one another in a row. These floats may include a variety of hardware integrated therewith for connecting the floats to one another, attaching underwater netting or barrier devices, attaching signage or upright fencing devices, etc. As a result, it is desirable that the floats be of a robust construction capable of being exposed to the elements for extended periods of time and capable of supporting the loading and structures mounted thereto.

Despite being of a robust construction as mentioned above, the floats of such barriers must be buoyant. To achieve this, contemporary waterway barrier floats are of a multi-component, multi-material construction. Indeed, they employ a hollow outer casing which is formed of a strong plastics material which provides the required degree of strength for the float. Inside this hollow outer casing is a low density urethane material used as a float body, which is desirable for its buoyancy capabilities and its light weight due to its low density construction.

FIG. 1 illustrates an example of such a known float 10 for a barrier of a waterway. As described above when discussing such known floats, the same incorporates an outer casing 12. Outer casing 12 contains a float body 14 within an interior space 16 formed by outer casing 12. In the illustrated view, a portion of casing 12 is cut away to expose float body 14 and interior space 16. Float 10 also typically includes some form of mounting hardware 28 which may be used to connect float 10 to an external device such as another float 10, netting, barriers, fencing, signage, etc. Float 10 is generally an elongate member having first and second ends 22, 24, and extends along a longitudinal axis 26. While illustrated as taking on a cylindrical shape, float 10 may take on a variety of other shapes.

Unfortunately, the above multi-component, multi-material construction of such floats has several drawbacks. First, the manufacture itself is a multi-stage process. It requires the manufacture of the hollow outer casing in a separate step from the manufacture of the internal float body. It also requires a separate step of attaching or forming any mounting hardware on the float. This step is typically done after the casing and float body are made and assembled.

Further, the outer casing of contemporary floats can become damaged inadvertently or intentionally, leaving the underlying float body exposed. Because the float body is formed from a low density urethane material, it is not nearly as robust as the hard outer casing. This low density urethane material may quickly become damaged from exposure to the elements, collisions, etc. Further, the low density urethane material is typically not the same color as the hard outer casing which itself is typically a bright orange or other safety oriented color. As such, once the hard outer casing is completely or partially obliterated, the underlying float body is much harder to see.

Accordingly, there is a need in the art for a float and a waterway barrier incorporating such a float which overcomes the above deficiencies. The invention provides as much. The invention provides the same. These and other advantages of the invention, as well as additional inventive features, will be apparent from the description of the invention provided herein.

BRIEF SUMMARY OF THE INVENTION

In one aspect, the invention provides a float for a barrier of a waterway. An embodiment of a float according to this aspect includes a float body. The float body has a generally elongated shape extending between first and second ends. The float body is caseless such that it is in direct contact with the water of a waterway. The float body is formed of a high density urethane material.

In certain embodiments according to this aspect, the float body is configured for connection to at least one other float body. The float body may include mounting hardware at at least one of the first and second ends for connecting the float body to an external device.

In certain embodiments according to this aspect, the float body includes a passage extending longitudinally through the float body. The passage extends along a longitudinal central axis of the float body, and is configured to route a guide line for stringing multiple float bodies together. The float may also include a sleeve lining the passage. The sleeve is formed of a material which is different than the material of the float body.

In certain embodiments according to this aspect, the float body includes mounting hardware which is co-molded into the float body such that it is anchored in the float body. The float body may be pigmented with a color. The float body may have a circular cross section, or a non-circular cross section.

In certain embodiments, the float body has a density of between about 20 $lb/ft^3$ and about 26 $lbs/ft^3$.

In another aspect, the invention provides a barrier for a waterway. An embodiment of a barrier according to this aspect includes a plurality of floats connected to on another to form a row. Each float includes a float body formed of a single, homogenous material.

In certain embodiments according to this aspect, each float body has a first and a second end. Each one of the plurality of floats may include mounting hardware for connecting its respective float body to an adjacent float body. The mounting hardware is situated at at least one of the first and second ends of the float body. The mounting hardware may be co-molded into the float body such that it is anchored in the float body.

In certain embodiments according to this aspect, the single homogeneous material is a high density urethane material.

In certain embodiments according to this aspect, the float body may include a passage extending longitudinally through the float body. The passage extends along a longitudinal central axis of the float body, and is configured to route a guide line for stringing multiple float bodies together to form the row of the waterway barrier. A sleeve may line the passage. The sleeve may be formed of a material which is different than the material of the float body.

In yet another aspect, the invention provides a method for forming a barrier for a waterway. An embodiment of a method according to this aspect includes forming a caseless float body. The caseless float body is configured for direct contact with water of the waterway during normal operation. The method also includes providing mounting hardware on the float body. The mounting hardware is configured for connecting an external structure to the float body.

In certain embodiments according to this aspect, the step of forming includes forming the float body using a high density urethane material.

In certain embodiments according to this aspect, the step of forming includes forming the float body of a single homogeneous material.

In certain embodiments according to this aspect, step of providing mounting hardware on the float body includes co-molding the mounting hardware with the float body.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 2:
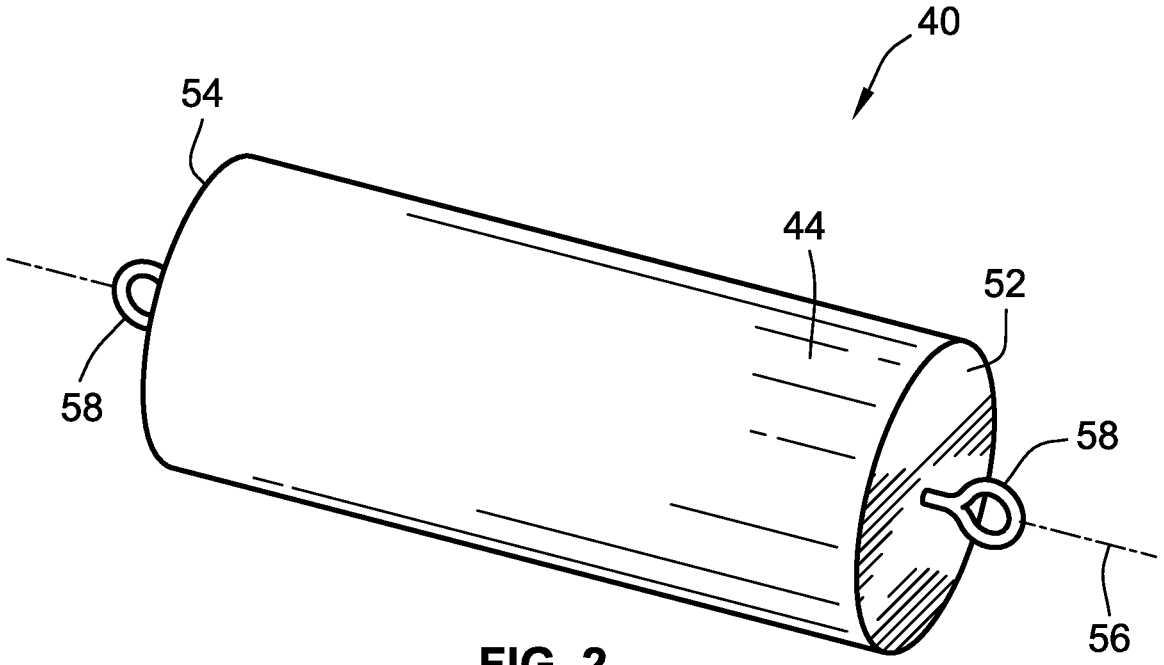
FIG. 2 is a perspective view of an embodiment of a float for a waterway barrier according to the teachings herein.

Turning now to the drawings, FIGS. 2-7 illustrate exemplary embodiments of a float for a barrier of a waterway according to the teachings herein. With particular reference to FIG. 2, the same illustrates a perspective view of a float 40 according to the teachings herein. Float 40 includes a float body 44. Float body 44 has an elongate shape and extends between first and second ends 52, 54 along a longitudinal axis 56 defined by float 40. In the illustrated embodiment, float 40 has a generally cylindrical shape as a result of the shape of float body 44. However, float body 44 may take on virtually any form and thus may have circular and non-circular cross sectional shapes, ad discussed below.

Float body 44 is formed of a single homogeneous material. As one example, float body 44 is formed of a high density urethane material which is molded to assume the shape of float 40. The Applicant has found that a density of between about 20 $lb/ft^3$ and about 26 $lbs/ft^3$ is particularly advantageous in that it on the one hand provides a desired strength and resiliency and on the other hand provides a desired buoyancy. The term "about" in the preceding density range is used to allow for those tolerances which are typical in density measurements of urethane foam in practice. The Applicant has found that float bodies of densities which are less than 20 $lb/ft^3$ do not provide satisfactory resilience and can become damaged or destroyed. The Applicant has also found that float bodies of densities which are greater than 26 $lb/ft^3$ are too dense, and have a tendency to over-submerge or sink.

Figure 1:
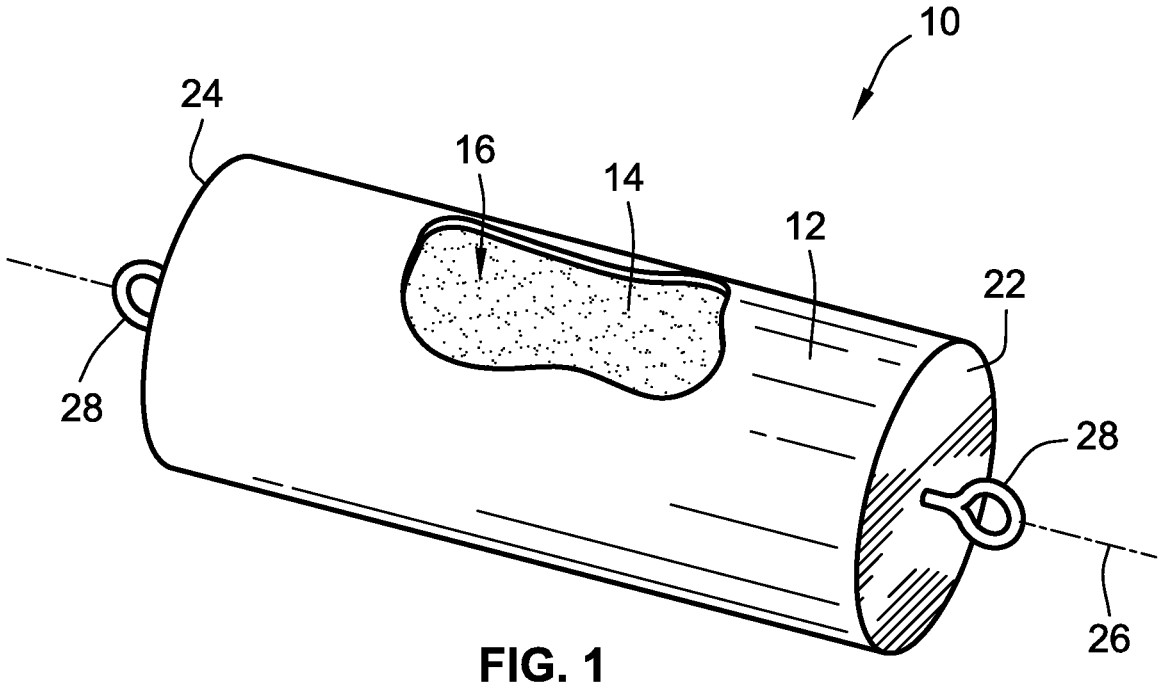
FIG. 1 (PRIOR ART)
FIG. 1 is a generally schematic perspective view of a known float for a barrier for a waterway.

This high density urethane material has the advantage of providing the strength benefits of a hard plastic outer casing without actually incorporating such a case. In other words, float 40 is caseless. "Caseless" as used herein means that float body 44 is not contained within an interior space defined by an outer casing, but is instead arranged and configured for direct contact with the water of a waterway in normal operation of float 40. "Normal operation" meaning the application of float 40 in its undamaged state in its intended environment. This is in direct contrast to those case-style designs described above and shown in FIG. 1, wherein the float body 14 there is not arranged and configured for direct contact with water of a waterway during normal operation. In those designs, it is outer casing 12 which is in contact the water during normal operation.

Such high density urethane material also provides the required buoyancy properties. Further such high density urethane material may be readily pigmented to assume a safety oriented color such as bright orange or the like. Such coloring is normally reserved for the hard outer casing in prior designs. Still further, other componentry such as mounting hardware 58 may be readily installed on float body 44, given that its high density urethane material may be molded to assume various shapes and is amenable to co-molding with such hardware, and given that such high density urethane may readily be subjected to conventional machining methods such as drilling and the like in order to incorporate such mounting hardware 58 into float 40.

It will be recognized that hardware 58 illustrated is only a schematic depiction. Any type of mounting hardware may be incorporated into float 40, either by co-molding the same into float body 44 as float body 44 is molded, or by subsequent attachment. Thus "mounting hardware" as used herein means any hardware used to connect float body 44 to an external device, such as another adjacent float body 44, barriers, signage, fencing, other mounting hardware, or any other device of the type used in contemporary barriers for waterways. Therefore, the particular shape of mounting hardware 58 should be taken as a non-limiting example only.

Figure 4:
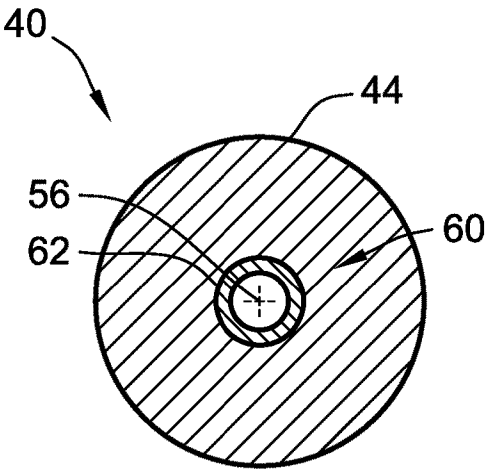
FIG. 4 is a cross section of the float of FIG. 2, incorporating a bore and a sleeve.
Figure 3:
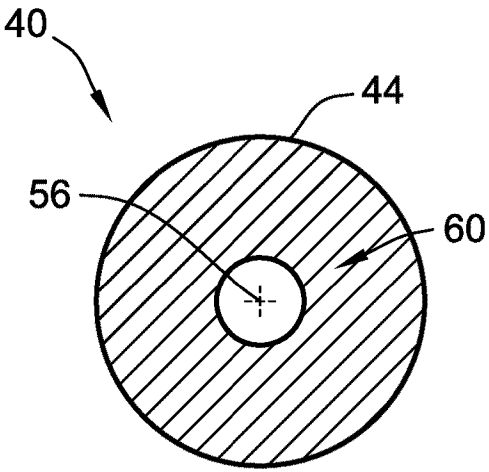
FIG. 3 is a cross section of the float of FIG. 2, incorporating a bore therethrough.

FIGS. 3-7 illustrate various examples float 40. FIG. 3 shows float 40 with a bore 60 extending through float body 44 along axis 56. Bore 60 and may extend the entirety of the length of float 40, or some lesser length. This bore 60 may have a circular or non-circular cross section. Further, it is also possible to move bore off center from axis 56. FIG. 4 is similar to the construction shown in FIG. 3, except that it also includes a sleeve 62 lining bore 60. This sleeve 62 may be of a metal material as a non-limiting example. Sleeve 62 is arranged and configured to prevent wear of the surfaces of bore 60 caused by a line, chain, or similar device passing through bore 60 and used to string multiple floats 40 together.

Figure 5:
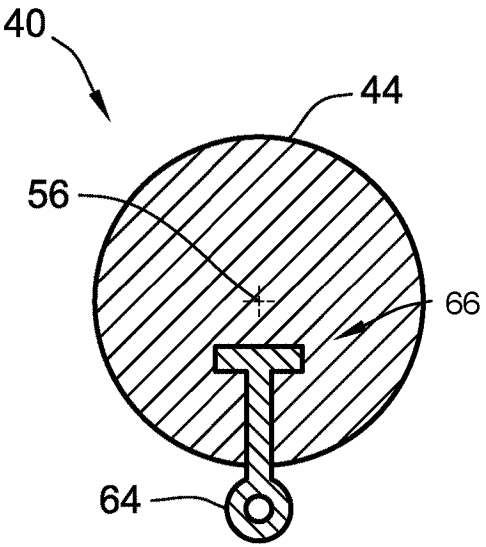
FIG. 5 is a cross section of the float of FIG. 2, incorporating mounting hardware.

FIG. 5 illustrates a construction of float 40 which incorporates mounting hardware 64 that has been co-molded with float body 44. It will be noted that in contrast to the axial extension of mounting hardware 58 relative to axis 56 shown in FIG. 2, mounting hardware 64 extends radially outward of float body 44 relative to axis 56. This mounting hardware 64 may include an anchor portion 66 used to affix the position of mounting hardware 64 in float body 44 during molding. Anchor portion 66 may take on any form useful for anchoring mounting hardware 64 within float body 44.

Figure 6:
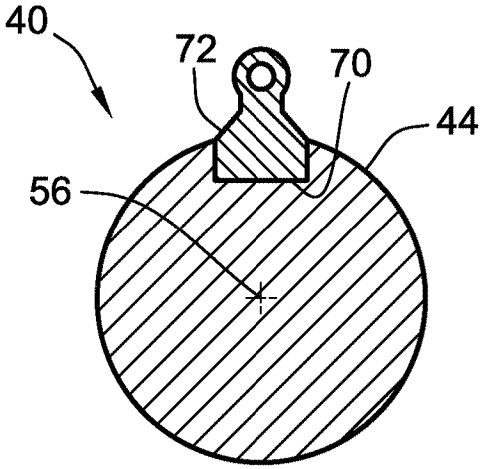
FIG. 6 is a cross section of float of FIG. 2, incorporating a channel therethrough which is off-center from a central longitudinal axis of the float and incorporates mounting hardware.

FIG. 6 illustrates a construction of float 40 which includes a channel 70 which may be molded in, or subsequently machined in. This channel 70 may subsequently receive mounting hardware 72 as shown. Channel 70 is off center relative to axis 56, and may extend the entirety of the length of float 40, or some lesser length.

Figure 7:
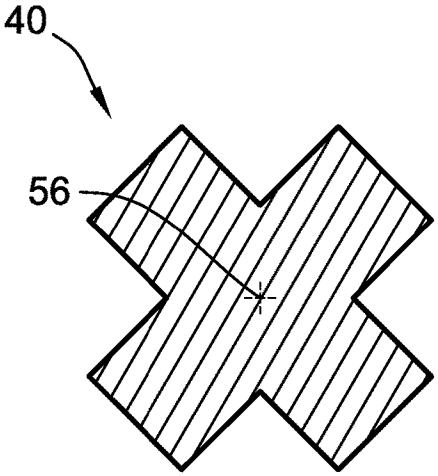
FIG. 7 is a cross section of the float of FIG. 2, incorporating a non-circular cross section.

FIG. 7 illustrates a construction of float 40 which does not incorporate a circular cross section. Indeed, because float body 44 is readily moldable, the same may be molded into virtually any shape.

It will be recognized from the teachings herein that the various features shown in FIGS. 3-7 are not mutually exclusive of one another. That is, a float 40 having a bore 60 may also incorporate a channel 70 and mounting hardware 72, as only one of many examples.

Figure 8:
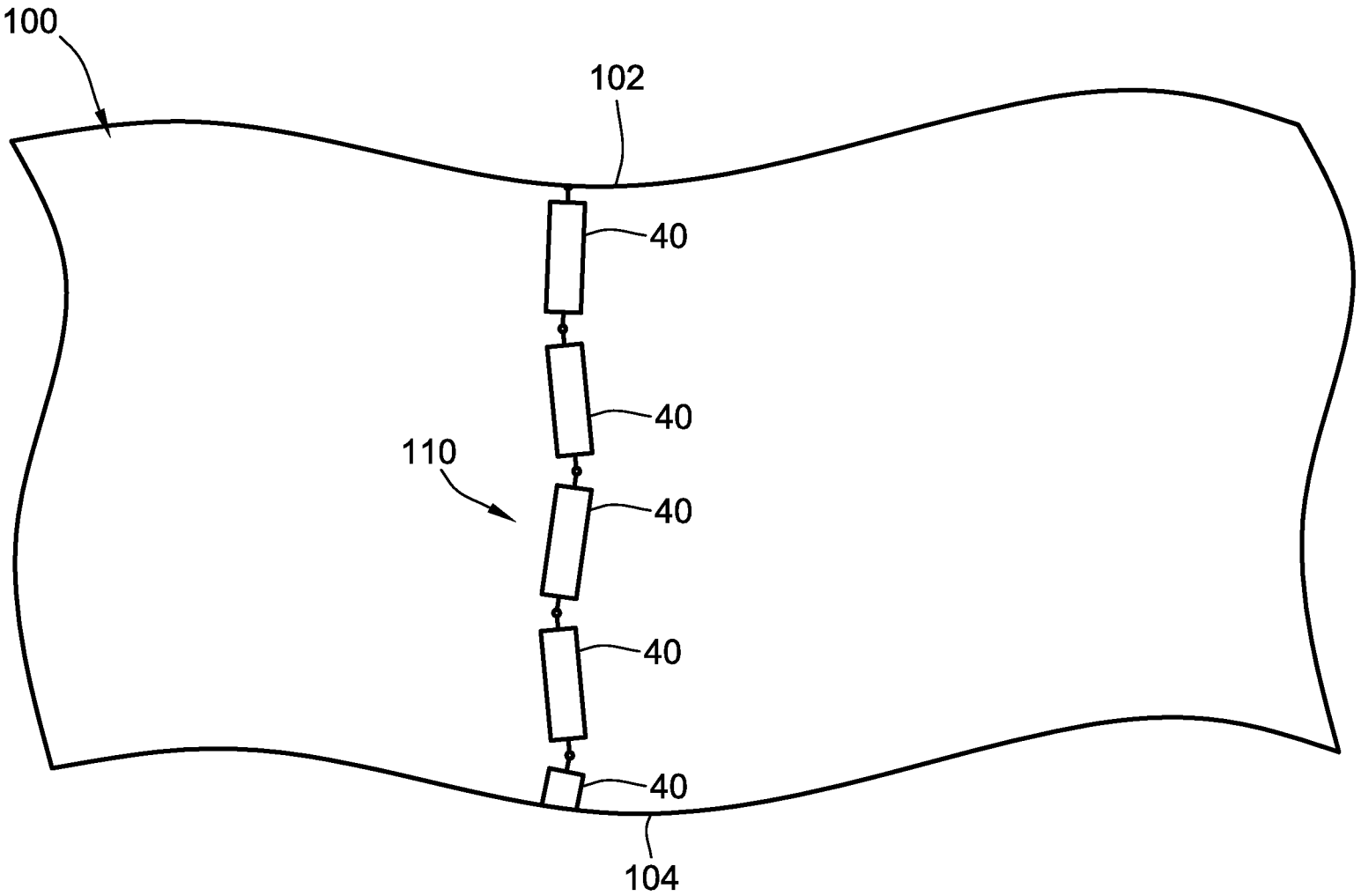
FIG. 8 is a plan view of a barrier incorporating a plurality of floats of the type shown in FIG. 2.

FIG. 8 illustrates a waterway 100 having opposing banks 102, 104. A barrier 110 formed by connecting a plurality of floats 40 according to the teachings herein to form a row extends between banks 102, 104. Floats 40 may be connected to one another for example using mounting hardware, or may be strung together using a common line or the like as discussed herein.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A float for a barrier of a waterway, the float comprising:

a float body, the float body having a generally elongated shape extending between first and second ends;

wherein the float body is caseless such that it is in direct contact with the water of a waterway;

wherein the float body is formed of a single homogenous high density urethane material having a density between 20 lb/ft$^3$ and about 26 lbs/ft$^3$; and mounting hardware co-molded into the float body such that it is anchored in the float body.

2. The float of claim 1, wherein the float body is configured for connection to at least one other float body.

3. The float of claim 2, wherein the float body includes mounting hardware at least one of the first and second ends for connecting an external device to the float body.

4. The float of claim 1, wherein the float body includes a passage extending longitudinally through the float body.

5. The float of claim 4, wherein the passage extends along a longitudinal central axis of the float body, and is configured to route a guide line for stringing multiple float bodies together.

6. The float of claim 5, further comprising a sleeve lining the passage, wherein the sleeve is formed of a material which is different than the material of the float body.

7. The float of claim 1, wherein the float body is pigmented with a color.

8. The float of claim 1, wherein the float body has a circular cross section.

9. The float of claim 1, wherein the float body has a non-circular cross section.

10. A barrier for a waterway, the barrier comprising:

a plurality of caseless floats connected to one another to form a row;

wherein each caseless float comprises a float body, the float body having a generally elongated shape extending between first and second ends, the float body formed of a single, homogenous high density urethane material which is arranged and configured for direct contact with water of the waterway;

wherein the single homogeneous high density urethane material has a density between 20 lb/ft$^3$ and about 26 lbs/ft$^3$;

wherein each one of the plurality of caseless floats further comprises mounting hardware for connecting its respective float body to an adjacent float body, and wherein the mounting hardware is co-molded into the float body such that it is anchored in the float body.

11. The barrier of claim 10, wherein the mounting hardware is situated at at least one of the first and second ends of the float body.

12. The barrier of claim 10, wherein the float body includes a passage extending longitudinally through the float body.

13. The barrier of claim 12, wherein the passage extends along a longitudinal central axis of the float body, and is configured to route a guide line for stringing multiple float bodies together to form the row of the waterway barrier.

14. The barrier of claim 13, further comprising a sleeve lining the passage, wherein the sleeve is formed of a material which is different than the material of the float body.

15. A method for forming a barrier for a waterway, comprising:

forming a plurality of caseless float bodies, each one of the plurality of caseless float bodies formed of a single homogenous high density urethane material having a density between 20 $lb/ft^3$ and about 26 $lbs/ft^3$ and configured for direct contact with water of the waterway during normal operation;

providing mounting hardware on each one of the plurality of caseless float bodies by co-molding the mounting hardware in the caseless float body; and wherein the mounting hardware is configured for connecting to at least another one of the plurality of caseless float bodies.

16. The method of claim 15, wherein the step of forming includes forming the float body using a high density urethane material.

17. The method of claim 15, wherein the step of forming includes forming the float body of a single homogeneous material.

* * * * *